US005657797A

United States Patent [19]

Townley et al.

[11] Patent Number: 5,657,797

[45] Date of Patent: Aug. 19, 1997

[54] PRESS FELT RESISTANT TO NIP REJECTION

[75] Inventors: Glenn C. Townley; Francis J. Cunnane, both of Greer, S.C.

[73] Assignee: Asten, Inc., Charleston, S.C.

[21] Appl. No.: 595,668

[22] Filed: Feb. 2, 1996

[51] Int. Cl.[6] ..... D03D 11/00

[52] U.S. Cl. ..... 139/383 AA; 139/383 A; 28/110; 34/116; 442/206

[58] Field of Search ..... 139/383 A, 383 AA; 428/234, 300; 28/110; 34/116, 123

[56] References Cited

U.S. PATENT DOCUMENTS

| | | | |
|---|---|---|---|
| 4,290,209 | 9/1981 | Buchanan et al. . | |
| 4,403,632 | 9/1983 | Romanski et al. | 139/383 AA |
| 4,438,789 | 3/1984 | MacBean | 139/383 AA |
| 4,683,624 | 8/1987 | Dufour . | |
| 4,806,208 | 2/1989 | Penven . | |
| 4,806,413 | 2/1989 | Penven . | |
| 4,824,525 | 4/1989 | Penven . | |
| 4,842,925 | 6/1989 | Dufour et al. . | |
| 4,842,929 | 6/1989 | Dufour et al. . | |

FOREIGN PATENT DOCUMENTS

| | | | |
|---|---|---|---|
| 2 226 578 | 7/1990 | United Kingdom | 139/383 AA |

OTHER PUBLICATIONS

Advertisement Sheet for ASF-100—Asten Press Fabrics, Inc. (undated).

*Primary Examiner*—Andy Falik

*Attorney, Agent, or Firm*—Volpe and Koenig, P.C.

[57] ABSTRACT

Cross machine stuffer yarns are used in the construction of a base fabric for a papermakers wet felt. The stuffer yarns in combination with a multiple pass heat setting process stabilize the machine direction yarns of the base fabric to provide resistance to nip rejection. Preferably a fibrous batt is needled to the base fabric to finish the wet press felt.

11 Claims, 5 Drawing Sheets

PRESS FELT RESISTANT TO NIP REJECTION

BACKGROUND OF THE INVENTION

1. Field of the Invention

The present invention relates to papermakers fabrics, more particularly to a press fabric resistant to nip rejection and a method for making same.

2. Description of Related Art

Wet press felts are used in the press section of papermaking machines to transport and dewater an aqueous paper web which is being made into a desired paper product. The dewatering process conventionally entails transporting the aqueous web through a series of press nips. The aqueous paper web is carried on a press felt through at least one nip defined between two metal rolls which squeezes water from the paper web into the underlying press felt.

When in use, press felts are under tension to maintain uniformity in the fabric. However, this tension combined with the high pressures in traveling through the nip may not be sufficient to straighten the press felt yarns just before the press felt enters the press nip. If the press nip load is high and the felt yarns are not straight, they may exhibit a type of scissoring effect which results in a collection or bunching up of yarns at the entrance to the press nip known as nip rejection. Nip rejection is undesirable since it can damage the press felt fabric and cause undesirable marking or irregularities in the paper product itself.

Nip rejection can be combated by increasing the tension in the fabric through the nip. However, many papermaking machines cannot physically exert the amount of tension on the fabric needed to consistently eliminate nip rejection problems. In addition, after running for a day or two, the effects of the added tension disappear since the caliper of the fabric is decreased due to maximum allowable stretching of the fabric. In addition, excessive tension of the press fabric increases the potential for "roping" or "folding over" of the fabric which can result in complete wreckage of the fabric, damage to the paper product and possible damage to the papermaking machine.

It would be desirable to provide a press felt which is resistant to nip rejection.

SUMMARY OF THE INVENTION

The present invention is directed to a wet press felt which includes a base fabric woven from synthetic yarns. After weaving, the base fabric is subjected to a special three stage heat setting process to make the fabric resistant to nip rejection. The heat setting process includes heat setting the fabric at a relatively high temperature and tension at two passes and a third pass of heat setting the synthetic base fabric at a lower temperature.

In the preferred embodiment, the base fabric is woven in a simple two layer weave structure having a system of machine direction yarns interwoven with two layers of cross machine direction yarns. Preferably an intermediate layer of monofilament cross machine direction stuffer yarns are provided in the natural voids occurring in the simple two layer weave pattern. The inclusion of the monofilament stuffer yarns in combination with the three stage heat setting process significantly enhances the fabric's resistance to nip rejection.

It is an object of the invention to provide a wet press base fabric which is resistant to nip rejection.

It is a further object of the invention to provide a wet press felt base fabric which maintains its caliper over time.

It is yet a further object of the invention to provide a wear resistant wet,press felt base fabric.

Other objects and advantages will be apparent to those skilled in the art from the following detailed description of a presently preferred embodiment.

DETAILED DESCRIPTION OF A PREFERRED EMBODIMENT

Figure 1:
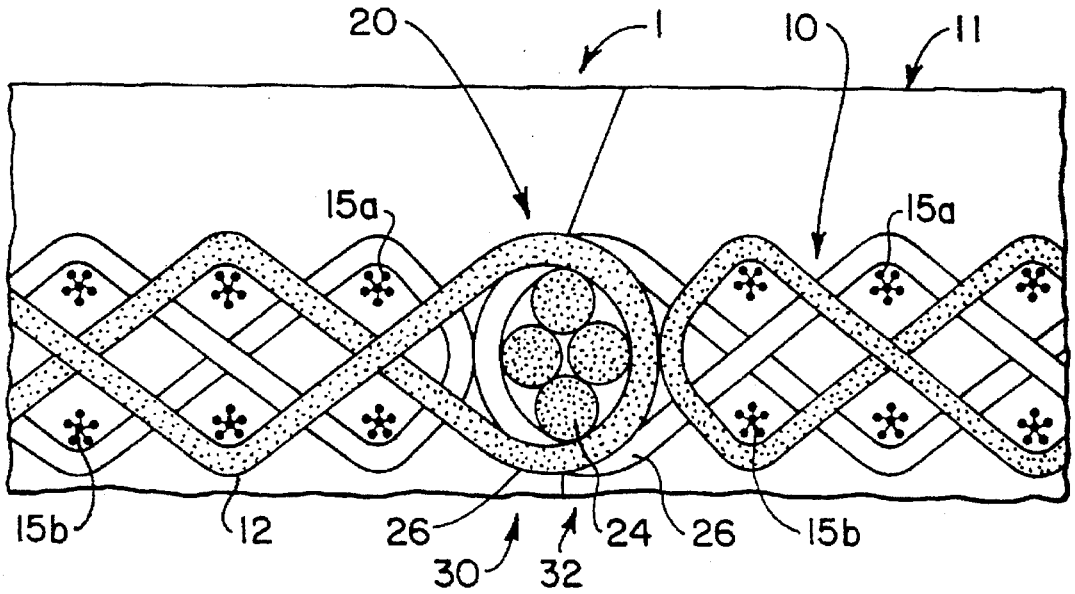
FIG. 1 PRIOR ART
FIG. 1 is a sectional view of a prior art press felt.
Figure 2:
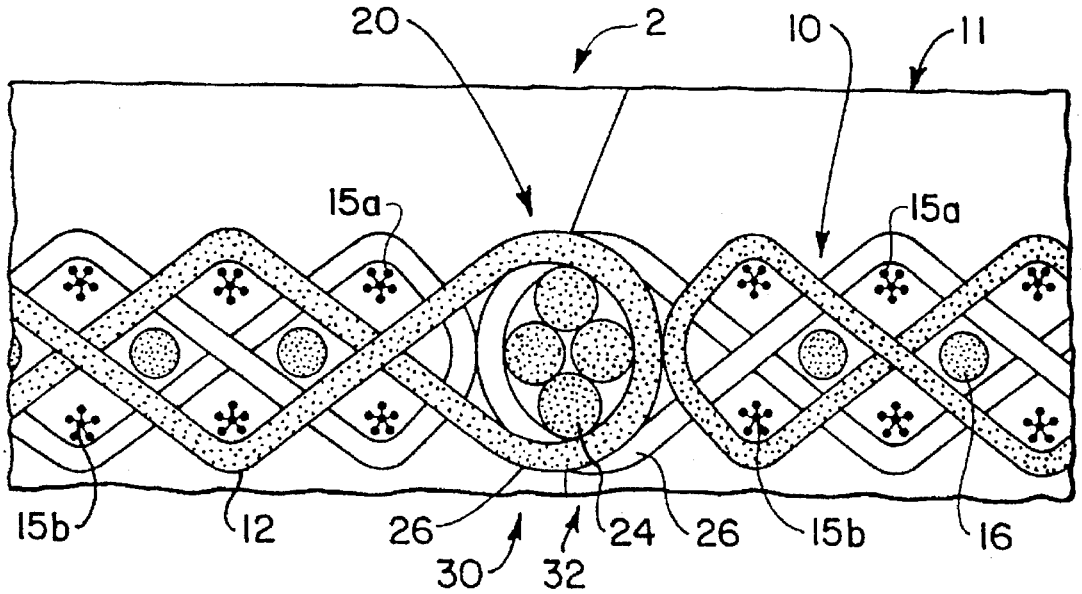
FIG. 2 is a sectional view of a press felt made in accordance with the teachings of the present invention.

Referring to FIG. 1 and 2 there is shown a prior art press felt 1 and a press felt 2 made in accordance with the teachings of the present invention. Both press felts 1, 2 comprises a base fabric 10 to which batt material 11 is needled in a conventional manner.

In both felts 1, 2, the base fabric 10 is preferably comprised of a repeat of four monofilament machine direction (MD) yarns 12, interwoven with an eight shed repeat system of multi-filament cross machine direction (CMD) yarns 15*a,b* to define a woven fabric having two layers of multi-filament cross machine direction yarns. A seam 20 is provided which includes seaming loops 26 formed on opposing fabric ends 30 and 32. In seaming, the loops 26 are intermeshed and maintained together by pintle members 24 thereby rendering the base fabric 10 endless in a conventional manner. One prior art press as depicted in FIG. 1 is the ASF-100™ press felt available from Asten, Inc., the assignee of the present invention.

As illustrated in FIG. 2, the press felt made in accordance with the teachings of the present invention includes an intermediate layer of monofilament stuffer yarns 16 disposed within the natural voids defined in the prior art two layer weave pattern. Additionally, as the described in more detail below, a special three stage heat setting process is used in finishing the base fabric after weaving to reduce residual shrinkage of the synthetic yarns. The combination of the inclusion of monofilament CMD yarns in the natural voids of the prior art weave in conjunction with the three stage heat setting process renders the press felt 2 substantially more resistant to nip rejection than the prior art press felt 1.

Figure 3A:
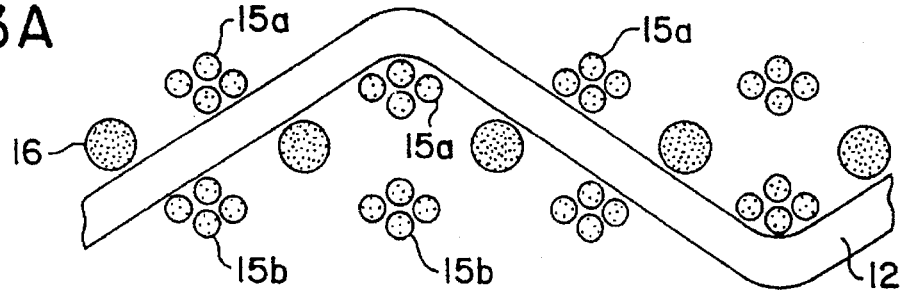
FIGS. 3*a–d* are sectional views of the weave pattern of the present invention showing a single MD yarn.
Figure 3B:
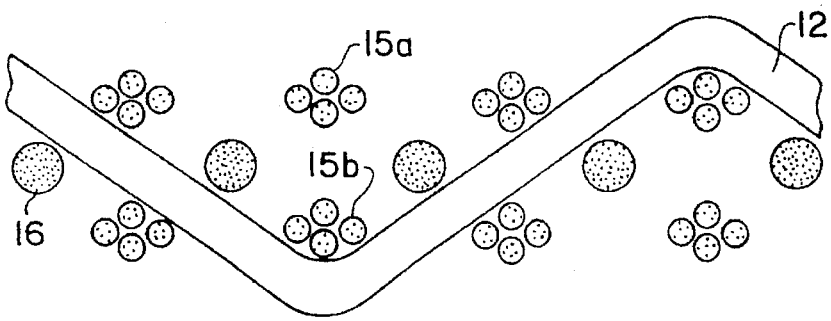
Figure 3C:
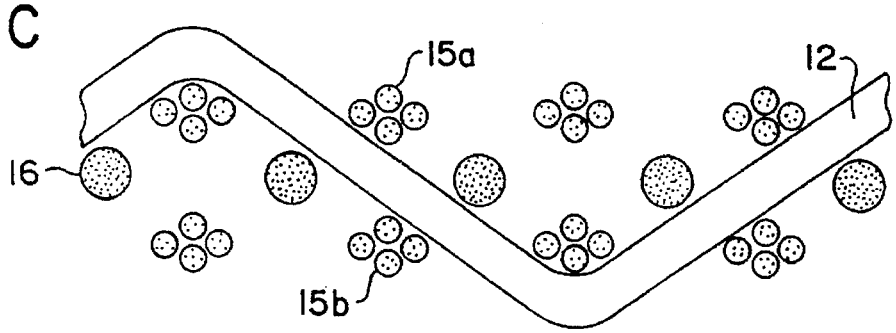
Figure 3D:
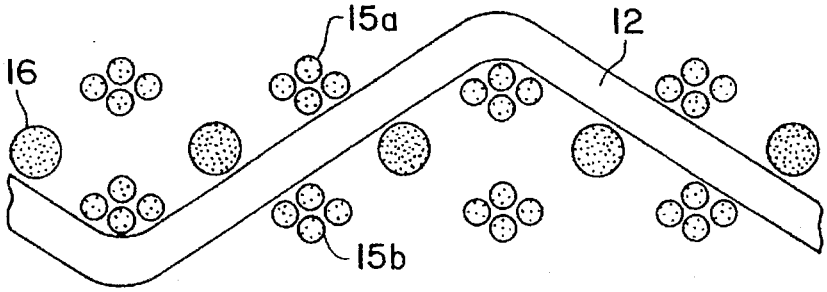

Referring to FIGS. 3*a–3d*, there is shown in detail the complete repeat pattern for each MD yarn 12 of the four MD yarn repeat of the base fabric for the felt depicted in FIG. 2. Preferably, the first MD yarn of the repeat weaves as shown in FIG. 3*a*, the second MD in the repeat we use as shown in FIG. 3*b*, the third MD yarn of the repeat weaves as shown in FIG. 3*c* and the fourth MD yarn of the repeat weaves as shown in FIG. 3*d*.

The CMD stuffer yarns 16 are disposed between the two layers of CMD yarns 15*a* and 15*b*. The CMD stuffer yarns 16 fill the void spaces between adjacent pairs of CMD filling yarns 15*a* and 15*b* and surrounding MD yarns 12. The CMD stuffer yarns 16 do not rise to either the surface of the base fabric 10. Although it is known in the art to use bulky or deformable yarns in the voids of such two layer fabrics to reduce permeability, the monofilament CMD stuffer yarns 16 of the present invention provide increased dimensional stability to the base fabric 10 by preventing movement of woven MD yarns 12, especially when placed through a nip press.

In one example, the MD yarns are preferably woven 72 yarns per inch of 0.019 inch diameter nylon monofilament yarns, each layer of CMD filling yarns 15*a*, 15*b* are preferably woven 11 yarns per inch of 0.008 inch/2/2 nylon cable yarn and the CMD stuffer yarns 16 are also 0.019 inch diameter monofilament nylon yarns. The CMD filling yarns 15*a,b* can be either cabled or single monofilament. The CMD stuffer yarn can be either cabled, monofilament, monofilament plied or multifilament yarns, but monofilament yarns are preferred and are believed to produce the greatest resistance to nip rejection. Preferably the fabric exhibits a permeability range of 15 to 110 CFM.

Figure 4:
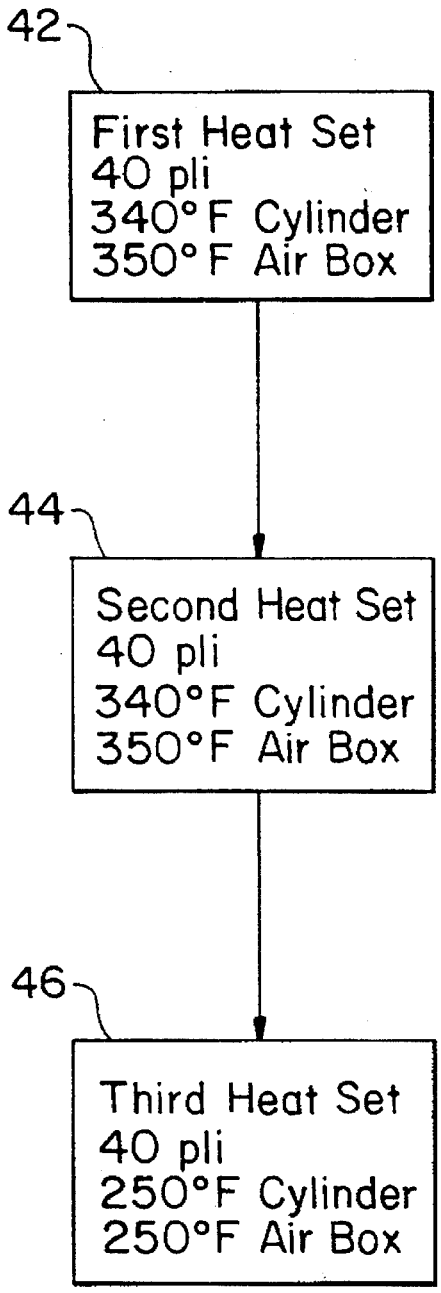
FIG. 4 is a block diagram of a method of heat setting the press felt fabric in accordance with the teachings of the present invention.

As shown in FIG. 4, the press felt base fabric 10 is heat set using conventional heat setting equipment in a series of three passes first heat set pass 42, a second heat set pass 44 and final heat set pass 46. The first and second heat setting passes 42 and 44 are each performed while maintaining a 40 pounds per linear inch (pli) tension on the fabric with a 340° F. cylinder and 350° F. air box. The 40 pli tension is also maintained in the final heat setting step. However, the temperatures are then dropped on the third heat set pass 46 to 250° F. All three heat setting passes are preferably performed at a speed of 4 feet per minute for the fabric length.

Although specific temperature preferences are provided, the temperature in the first and second heat set passes preferably is within a range of 340° F. to 360° F. and, in the third heat setting pass, the temperature is preferably maintained in a range of 240° F. to 260° F.

The three stage heat setting process is intended to reduce or eliminate any residual dimensional change characteristic in the machine direction yarns. It is believed that the heat setting process in conjunction with the use of the monofilament stuffer CMD yarns 16 combine to provide a reduced and relatively stable crimp in the machine direction yarns. Accordingly, such stabilization of the crimp in the machine direction yarns is believed to provide the resultant nip rejection resistance exhibited by the inventive press felts.

Figure 5A:
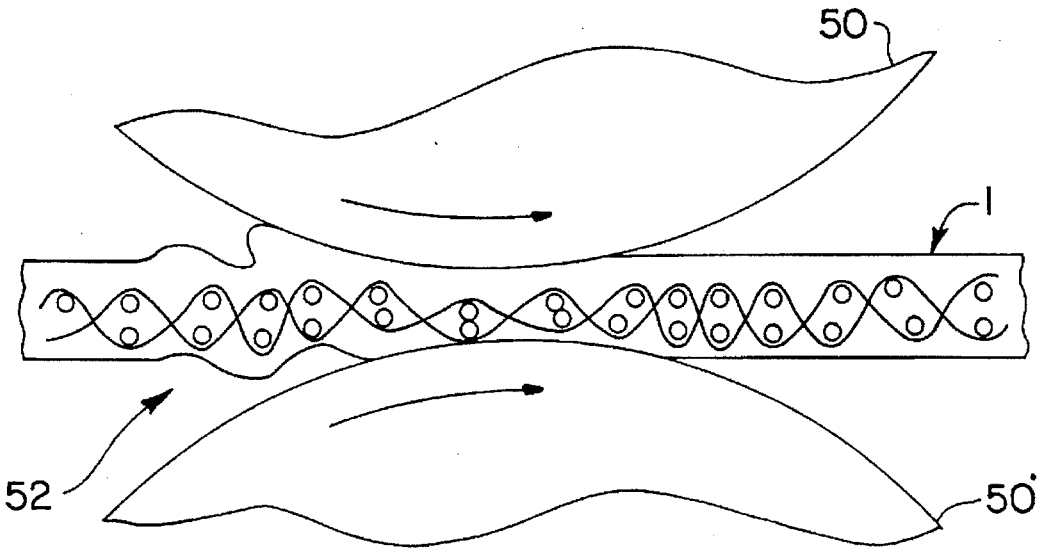
FIG. 5A PRIOR ART
FIG. 5*a* is a schematic diagram illustrating a prior art fabric as it travels through a press nip.
Figure 6A:
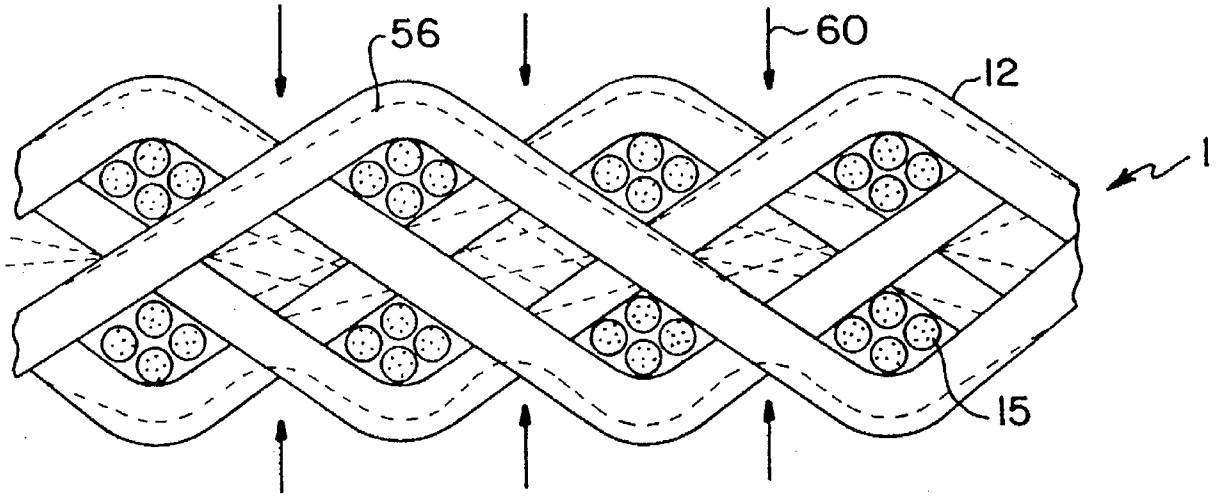
FIG. 6A PRIOR ART
FIG. 6*a* is a sectional view of a prior art press fabric deflecting as it travels through a press nip.

As schematically illustrated in FIG. 5*a*, the conventional press fabric 1 is susceptible to buildup of fibers at the entrance 52 of the press nip defined by press rollers 50. As shown more clearly in FIG. 6*a*, the conventional press fabric 1 experiences substantial vertical deflection, represented by dashed lines 56, due to the loads 60 resulting from the press nip. Due to the void spaces present in the prior art fabrics, a scissoring or springing action results.

Figure 5B:
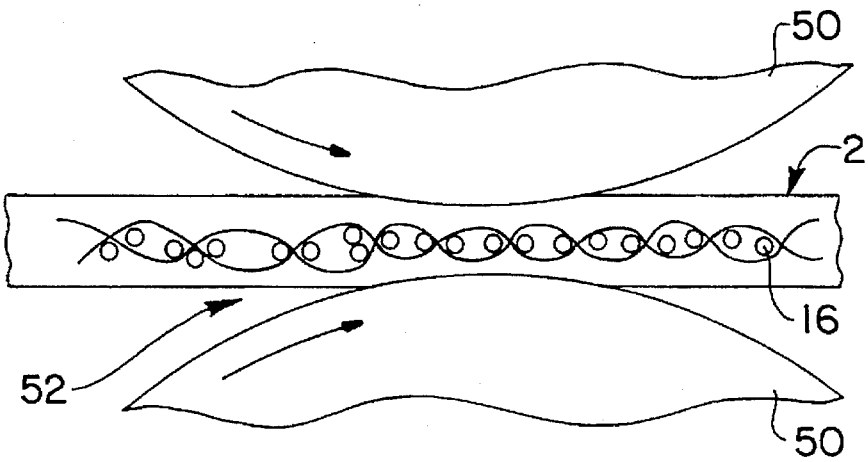
FIG. 5*b* is a schematic diagram illustrating the press fabric depicted in FIG. 1 as it travels through a press nip.
Figure 6B:
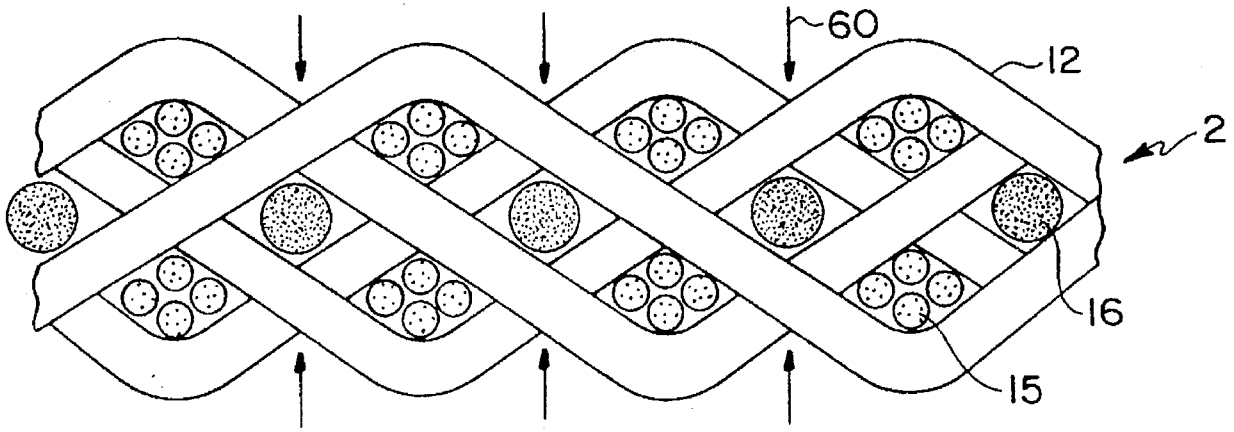
FIG. 6*b* is a sectional view illustrating the press fabric depicted in FIG. 1 as it travels through a press nip with minimal deflection.

FIG. 5*b* illustrates the press felt 2 made in accordance with the teachings of the present invention passing through the press nip defined by rollers 50. As shown more clearly in FIG. 6*b*, the press felt base fabric 10 which has been previously heat set as described above, includes stuffer yarns 16 which prevent the fabric 10 from excessively compressing and causing building at the entrance 52 to the nip 50.

While the present invention has been described in terms of the preferred embodiment, other variations which are within the scope of the invention as defined in the claims will be apparent to those skilled in the art.

We claim:

1. A wet press felt having increased nip rejection resistance for use under tension in the press section of a papermaking machine comprising:

a woven base fabric having a system of synthetic machine direction yarns interwoven with a system of cross machine direction yarns in a repeat pattern of four monofilament machine direction yarns interwoven with an eight shed repeat system of cross machine direction yarns arranged in two layers which creates natural voids within the cross machine direction system;

means for stabilizing the machine direction crimp of said synthetic machine direction yarn including:

synthetic monofilament cross machine direction stuffer yarns disposed within said natural voids of said CMD yarn system to define an intermediate layer of cross machine direction yarns; and said base fabric having been heat set in multiple passes at a time at least as great as the maximum tension which will be placed on the fabric in its intended use at a first temperature in an initial heat setting pass and at a second lower temperature in a subsequent heat setting pass.

2. A wet press felt according to claim 1 further comprising fibrous batt material needled onto said base fabric.

3. A wet press felt according to claim 1, wherein said machine direction yarns are woven 72 yarns per inch of 0.019 inch diameter nylon yarns.

4. A wet press felt according to claim 3, wherein each of said two layers of cross machine direction yarns are 11 yarns per inch of 0.008 inch/2/2 nylon cable yarns and said cross machine direction stuffer yarns are 0.019 inch diameter monofilament nylon yarns.

5. A wet press felt according to claim 1 wherein said base fabric, after weaving, has been heat set in three passes at a tension of approximately 40 pound per linear inch and a temperature in the first and second passes in the range of 340° F. to 360° F. and a temperature in the third pass in the range of 240° F. to 260° F.

6. A method for increasing the resistance to nip rejection in a press felt which includes a woven base fabric having a system of synthetic machine direction yarns interwoven with a system of cross machine direction yarns in a repeat pattern wherein natural voids are defined within the cross machine direction yarn system comprising:

incorporating monofilament cross machine direction stuffer yarns in weaving the base fabric to fill the naturally occurring voids in the CMD yarn system; and heat setting the base fabric in multiple passes under a tension at least as great as the tension under which the fabric is to be used and at a first temperature in an initial heat setting pass and at a second lower temperature in a subsequent heat setting pass.

7. A method according to claim 6 wherein the heat setting of the base fabric includes a first heat set pass in the range of 340° F. to 360° F. and at 40 pli tension.

8. A method according to claim 7 wherein the heat setting of the base fabric includes a second heat set pass in the range of 340° F. to 360° F. and at 40 pli tension and a third heat set pass at said second lower temperature.

9. A method according to claim 8 wherein the third heat set pass is in the range of 240° F. to 260° F. at 40 pli tension.

10. A method according to claim 6 wherein said heat set passes are performed at a speed of about 4 feet a minute.

11. A method according to claim 6 further comprising needling batt material onto the base fabric.

* * * * *

UNITED STATES PATENT AND TRADEMARK OFFICE
CERTIFICATE OF CORRECTION

PATENT NO. : 5,657,797

DATED : August 19, 1997

INVENTOR(S) : Glenn C. Townley et al.

It is certified that error appears in the above-identified patent and that said Letters Patent is hereby corrected as shown below:

On title page, item [54] and col. 1, line 2,

In the title, after the word "REJECTION", insert --AND METHOD--

At column 2, line 29, delete "Fig." and insert --Figs.-- therefor.

At column 2, line 52, delete "the" after the word "as".

IN THE CLAIMS

In claim 1, on line 19, delete "time" and insert --tension-- therefor.

In claim 5, on line 36, delete "pound" and insert --pounds-- therefor.

UNITED STATES PATENT AND TRADEMARK OFFICE

CERTIFICATE OF CORRECTION

PATENT NO. : 5,657,797

DATED : August 19, 1997

INVENTOR(S) : Glenn C. Townley et al.

It is certified that error appears in the above-indentified patent and that said Letters Patent is hereby corrected as shown below:

In claim 9, on line 2, insert --and-- before the word "at".

Signed and Sealed this

Fourth Day of November, 1997

*Attest:*

Bruce Lehman

BRUCE LEHMAN

*Attesting Officer*

*Commissioner of Patents and Trademarks*